United States Patent [19]

Lindsay

[11] Patent Number: 4,884,421

[45] Date of Patent: Dec. 5, 1989

[54] DOOR DEADBOLT LOCK

[76] Inventor: Stephen L. Lindsay, 34050 Wadsworth, Livonia, Mich. 48150

[21] Appl. No.: 208,973

[22] Filed: Jun. 20, 1988

[51] Int. Cl.[4] ..... E05B 65/06

[52] U.S. Cl. ..... 70/129; 70/432; 292/148

[58] Field of Search ..... 70/54, 55, 56, 129, 70/DIG. 59, 432, 417; 292/148, 205; 40/634, 666, 667

[56] References Cited

U.S. PATENT DOCUMENTS

| | | | |
|---|---|---|---|
| 273,685 | 3/1883 | Huntley | 70/DIG. 59 |
| 438,505 | 10/1890 | Tate | 70/432 |
| 986,296 | 3/1911 | Kavanagh | 70/432 |
| 1,653,581 | 12/1927 | McKeller | 40/634 X |
| 2,198,079 | 4/1940 | Ferris et al. | 70/129 X |
| 2,201,127 | 5/1940 | Schechter | 40/634 X |
| 2,482,341 | 9/1949 | Holmsten | 292/148 |
| 2,535,262 | 12/1950 | Brownsey | 40/666 X |
| 2,755,814 | 7/1956 | Hedland | 40/634 X |
| 3,374,020 | 3/1968 | Berg | 292/148 X |
| 3,451,703 | 6/1969 | Roegner | 292/148 |
| 3,493,256 | 2/1970 | Ramler | 70/432 |
| 3,599,453 | 8/1971 | Bauernfeind | 70/129 |
| 4,095,828 | 6/1978 | East | 292/148 |
| 4,106,315 | 8/1978 | Dohanyos | 70/417 X |
| 4,214,783 | 7/1980 | Boegeman | 292/148 X |
| 4,229,956 | 10/1980 | Thorburn | 292/148 X |
| 4,238,941 | 12/1980 | Halopoff | 70/56 |
| 4,307,904 | 12/1981 | Daus | 292/148 |
| 4,491,354 | 1/1985 | Williams | 70/432 |
| 4,741,564 | 5/1988 | Alford | 292/205 X |
| 4,782,675 | 11/1988 | Thorburn | 70/129 |

FOREIGN PATENT DOCUMENTS

| | | | |
|---|---|---|---|
| 499017 | 11/1950 | Belgium | 292/148 |
| 636763 | 2/1962 | Canada | 70/432 |
| 3407034 | 9/1985 | Fed. Rep. of Germany | 70/432 |
| 853639 | 12/1939 | France | 292/148 |
| 1207708 | 2/1960 | France | 70/432 |
| 232559 | 8/1944 | Switzerland | 70/432 |
| 9672 | 4/1907 | United Kingdom | 292/148 |
| 139726 | 3/1920 | United Kingdom | 70/432 |
| 1119407 | 7/1968 | United Kingdom | 70/432 |

*Primary Examiner*—Gary L. Smith
*Assistant Examiner*—Suzanne L. Dino
*Attorney, Agent, or Firm*—Harness, Dickey & Pierce

[57] ABSTRACT

A deadbolt-type doorlock particularly useful for public buildings such as schools which enables the locked or unlocked condition of the lock to be visually displayed and also enables locking of the slide bolt in either its door locking or door unlocking position. The deadbolt lock includes a lock housing having a movable bolt assembly therein. A blade is fastened to the bolt and forms a hole which aligns with one of two bores through the lock housing when the bolt is in the door locking and door unlocking positions. A conventional padlock assembly of the type having a separate locking loop is used which passes through both of the lock housing bores. Indicia on the padlock assembly lock housing can be provided on its two major face surfaces to designate the state of the lock.

1 Claim, 2 Drawing Sheets

DOOR DEADBOLT LOCK

BACKGROUND AND SUMMARY OF THE INVENTION

This invention relates to a locking device and particularly to a deadbolt type door lock.

For security reasons, it is necessary to lock entrance doors of homes and other buildings when they are unattended. For example, schools have numerous entrance doors which must all be securely locked after hours to prevent vandalism. School doors are typically chained and locked closed. The advantage of using chains is that they make it easy to visually inspect the door to insure that it is locked. Chains are, however, cumbersome to use and their use may violate local public building laws. Presently available deadbolt type locks do not provide a conspicuous visible indication of the locked and unlocked states which is advantageous to enable the lock to be easily checked from a distance by a custodian or security officer. For many door lock applications, such as schools, it is desirable to prevent entrance doors from being locked by an unauthorized person. Accordingly, it is further desirable to provide a door lock which can be secured in either its locked or unlocked conditions so that the state of the lock can be changed only by an authorized individual.

The above desirable features are achieved in accordance with this invention. The improved deadbolt door lock according to this invention employs a bolt assembly which can be secured in its locked or unlocked states and is adapted for use with a padlock which can be installed in different orientations and having indicia on its two major face surfaces for indicating the state of the lock.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
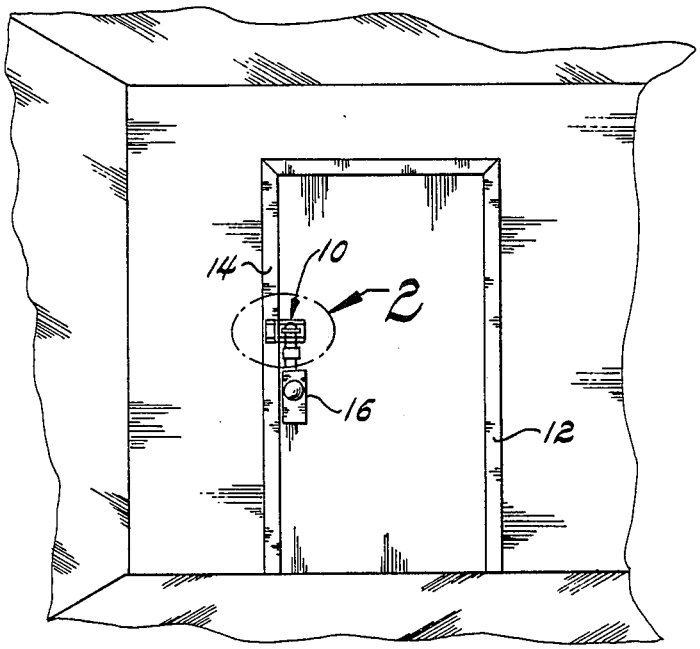
FIG. 1 is a pictorial view of a building entrance door incorporating the improved deadbolt lock according to this invention.

An improved deadbolt door lock according to this invention is shown in the figures and is generally designated by reference number 10. With reference to FIG. 1, lock 10 is shown installed on door 12 and engages with lock jam 14. Door 12 as shown in FIG. 1 is mounted to open in an outward direction which is typical of entrance doors provided for public buildings such as schools. The details of construction of deadbolt lock 10 are best described with reference to FIGS. 2 and 3.

Lock 10 principally comprises lock housing 20, bolt assembly 22, and padlock assembly 24.

Lock housing 20 has a flared base with mounting fastener holes 26 for suitable fasteners such as wood screws 28. Lock housing 20 forms an elongated square cross-section passageway 30 opening along its bottom and at aperture 32 which confronts lock jam 14. Lock body 20 forms a plate or spine 34 with an elongated slot 36 opening into passageway 30. A pair of separated bores 38 and 40 are formed through plate 34 traverse to slot 36.

Bolt assembly 22 includes bolt member 44 which is shaped to closely conform to the inside dimensions of passageway 30 and is slidable therein. Blade 46 is affixed to bolt 44 by fasteners such as roll pins or screws 48 and forms blade hole 50. Bolt assembly 22 is configured such that when bolt 44 is in a protruding locked condition, blade hole 50 is in alignment with lock housing bore 38. Conversely, when bolt assembly 22 is in its retracted unlocked position, blade hole 50 is aligned with lock housing bore 40. Bottom plates 52 is fastened to lock housing 20 by screws 53 to trap bolt assembly 22 in place.

Figure 5:
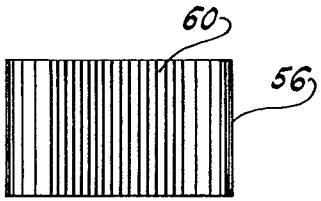
FIGS. 4 and 5 are side views of opposite sides of the lock body of the padlock assembly showing the use of different colors or other indicia on the two major face surfaces of the pad lock body.
Figure 4:
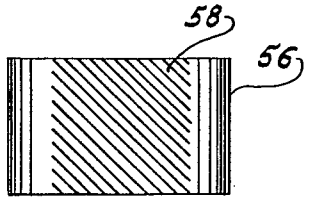

Padlock assembly 24 includes lock loop 54 which is completely separable from lock body 56. The separation distance between the legs of loop 54 is dimensioned so that the loop can be fitted onto lock body 20 such that the legs pass through bores 38 and 40. Preferably, lock body 56 has different colors or other indicia on its two face surfaces 58 and 60 as shown in FIGS. 4 and 5.

In use, when bolt assembly 22 is in the extended locked position, lock body 56 is placed onto loop 54 such that face surface 58 (shown in green) is displayed away from the door. When, however, bolt assembly 22 is in its retracted position, lock body 56 is loaded onto loop 54 such that face surface 60 (shown in red) is displayed. When used in this manner, deadbolt lock 10 provides a convenient color code recognizable from a distance which indicates the state of the lock. Once lock body 56 is installed onto loop 54, the desired face surface 58 or 60 will remain displayed since the lock body cannot be rotated once installed. In addition, in both locked and unlocked conditions of lock 10, bolt assembly 22 is securely retained in the desired position and thus unauthorized individuals cannot move the bolt to the locked position without first unlocking and disengaging padlock assembly 24.

Figure 2:
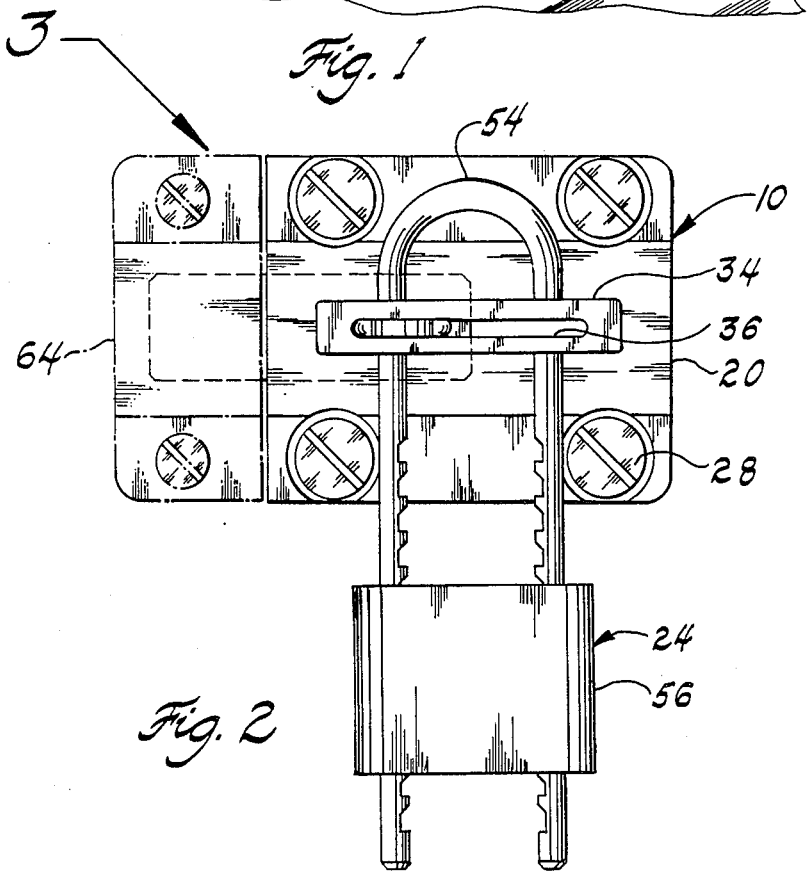
FIG. 2 is an enlarged pictorial view of the door lock according to this invention, taken from FIG. 1.
Figure 3:
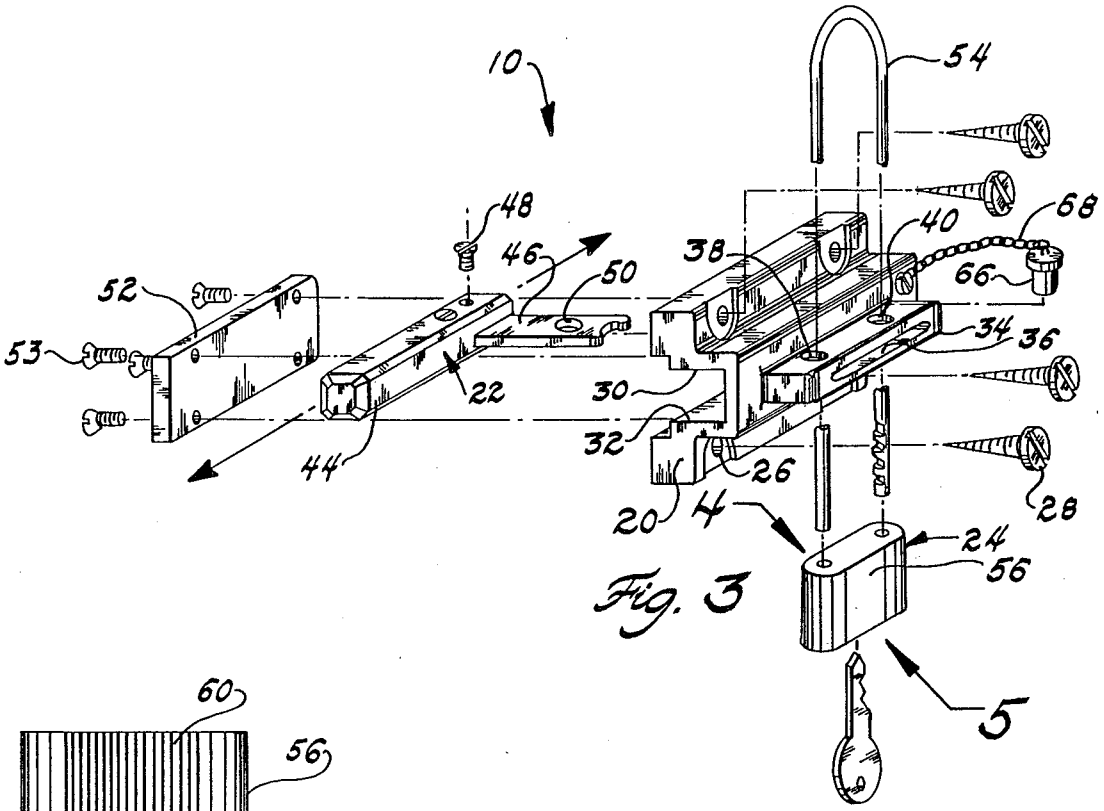
FIG. 3 is an exploded pictorial view of the improved lock according to this invention.

FIGS. 2 and 3 illustrate additional elements of an alternate embodiment of deadbolt door lock 10. For installations in residential settings where entrance doors open in an inward direction, lock 10 would not be positioned to engage a bolt receiving aperture within a lock jam. Accordingly, lock plate 64, shown in FIG. 2, is provided having a suitable aperture for receiving bolt assembly 22 and has a mounting plate which enables it to be secured to the lock jam for such installations. As shown in FIG. 3, a removable pin 66 can be used which may be placed into either of lock body bores 38 or 40, enabling lock 10 to be used without padlock assembly 24. Chain 68 maintains pin 66 fastened to lock housing 20.

While the above description constitutes the preferred embodiments of the present invention, it will be appreciated that the invention is susceptible to modification, variation and change without departing from the proper scope and fair meaning of the accompanying claims.

What is claimed is:

1. A deadbolt type door lock assembly comprising:

a lock housing having an elongated bolt passageway, a mounting flange for attachment of said housing to a door and an extending plate along said housing having an elongated slot parallel to and communicating with said bolt passageway with first and second bores formed through said plate and traverse across said slot, a bolt slidable in said bolt passageway between a retracted unlocked position and an extended locked position, a blade affixed to said bolt and movable within said plate slot and having a hole therethrough wherein when said bolt is in said extended position, said blade hole is aligned with said first lock housing bore and aligned with said second lock housing bore when said bolt is in said retracted position, a padlock assembly having a lock body with two major opposite face surfaces and a lock loop, said lock loop of a size to pass through both said lock housing bores and said blade hole with the bolt in either said extended or retracted positions, said lock loop being retained in place by said lock body with one of said major face surfaces displayed away from said door, said lock housing bores preventing said padlock assembly from being rotated to a position displaying the other of said opposite major face surfaces, and said lock body preventing removal of said lock loop by unauthorized persons to change the door unlocked or door locked condition of said lock, and distinguishable indicia on said two major opposite face surfaces which can be viewed at a distance from said door whereby said lock body can be fastened on said loop with a first of said indicia being displayed and can also be fastened on said loop so that a second of said indicia is displayed whereby said indicia may be used to designate the door unlocked or door locked condition of said lock.

* * * * *